US010490942B2

(12) United States Patent
Wu

(10) Patent No.: US 10,490,942 B2
(45) Date of Patent: Nov. 26, 2019

(54) LOCKING SOCKET WITH RELEASE MECHANISM

(71) Applicant: EXITO ELECTRONICS CO., LTD., Gueishan Hsiang, Taoyuan Hsien (TW)

(72) Inventor: Meng-Hsiu Wu, Taoyuan Hsien (TW)

(73) Assignee: EXITO ELECTRONICS CO. , LTD., Taoyuan (TW)

( * ) Notice: Subject to any disclaimer, the term of this patent is extended or adjusted under 35 U.S.C. 154(b) by 0 days.

(21) Appl. No.: 15/871,910

(22) Filed: Jan. 15, 2018

(65) Prior Publication Data

US 2019/0221970 A1 Jul. 18, 2019

(51) Int. Cl.

| | |
|---|---|
| ***H01R 13/62*** | (2006.01) |
| ***H01R 13/627*** | (2006.01) |
| ***H01R 13/635*** | (2006.01) |
| ***H01R 13/633*** | (2006.01) |
| ***H01R 13/629*** | (2006.01) |

(52) U.S. Cl.

CPC ..... *H01R 13/6335* (2013.01); *H01R 13/62* (2013.01); *H01R 13/627* (2013.01); *H01R 13/629* (2013.01); *H01R 13/635* (2013.01)

(58) Field of Classification Search

CPC .... H01R 13/62; H01R 13/627; H01R 13/629; H01R 13/635; H01R 13/20; H01R 13/24

See application file for complete search history.

(56) References Cited

U.S. PATENT DOCUMENTS

| | | | | |
|---|---|---|---|---|
| 8,616,904 | B1 * | 12/2013 | Martin | H01R 13/20 439/188 |
| 8,668,512 | B2 * | 3/2014 | Chang | H01R 24/78 439/304 |
| 10,020,616 | B2 * | 7/2018 | Hartman | H01R 43/26 |

* cited by examiner

*Primary Examiner* — Vanessa Girardi

(57) ABSTRACT

An anti-off socket includes a socket body defining therein an insertion space for receiving a blade of a plug, a locking mechanism including an elastic latch that has a positioning segment affixed to the socket body and an abutting segment extended from the positioning segment and inserted into the insertion space for allowing insertion of a blade of a plug into the insertion space and stopping the inserted blade from backward displace relative to the socket body after the inserted blade entered the insertion space, and a release mechanism including a release member mounted in the socket body and operable to release the elastic latch from the inserted blade of the plug for allowing removal of the plug from the socket body.

5 Claims, 7 Drawing Sheets

LOCKING SOCKET WITH RELEASE MECHANISM

BACKGROUND OF THE INVENTION

1. Field of the Invention

The present invention relates to electrical connector technology and more particularly, to an anti-off socket, which comprises a socket body for the insertion of a plug, a locking mechanism mounted in the socket body for locking the inserted plug in position, and a release mechanism for unlocking the locking mechanism to allow removal of the plug from the socket body.

2. Description of the Related Art

When connecting a plug to a socket, it is to insert the blades of the plug into the socket into contact with respective conducting terminals in the socket to achieve electrical conduction. However, if someone inadvertently kicks into the plug or steps on the power cord scattered on the floor to disconnect the plug from the socket, an accidental power failure can occur, causing equipment damage.

Furthermore, if a plug is plugged into a socket that is arranged on a vertical wall, the plug is easily pushed out of the socket by the gravity of the power cord connected to the plug. Power and other use of the inconvenience, causing power failure.

SUMMARY OF THE INVENTION

The present invention has been accomplished under the circumstances in view. It is therefore the main object of the present invention to provide an anti-off socket, which uses an elastic latch of a locking mechanism for locking an inserted plug in an insertion space in the socket body, prohibiting the plug from backward displacement relative to the socket body to cause power failure.

It is another object of the present invention to provide an anti-off socket, which uses a release member of a release mechanism in the socket body for operation by the user to bias the elastic latch of the locking mechanism in unlocking the inserted plug, allowing removal of the inserted plug from the socket body conveniently.

To achieve these and other objects of the present invention, an anti-off socket comprises a socket body, a locking mechanism and a release mechanism. The socket body defines therein an insertion space for receiving a blade of a plug. The locking mechanism is mounted in the socket body, comprising an elastic latch. The elastic latch comprises a positioning segment affixed to the socket body, and an abutting segment extended from the positioning segment and inserted into the insertion space. Upon insertion of a plug into the socket body, the abutting segment is biased by an inserted blade of the plug for allowing the inserted blade to enter the insertion space, and then forced by the elastic restoring energy of the elastic latch to return to the previous position and to stop the inserted blade from backward displace relative to the socket body after the inserted blade entered the insertion space. The release mechanism is mounted in the socket body, comprising a release member operable to bias the abutting segment of the elastic latch away from the inserted blade for allowing removal of the plug from the socket body.

DETAILED DESCRIPTION OF THE PREFERRED EMBODIMENT

Figure 1:
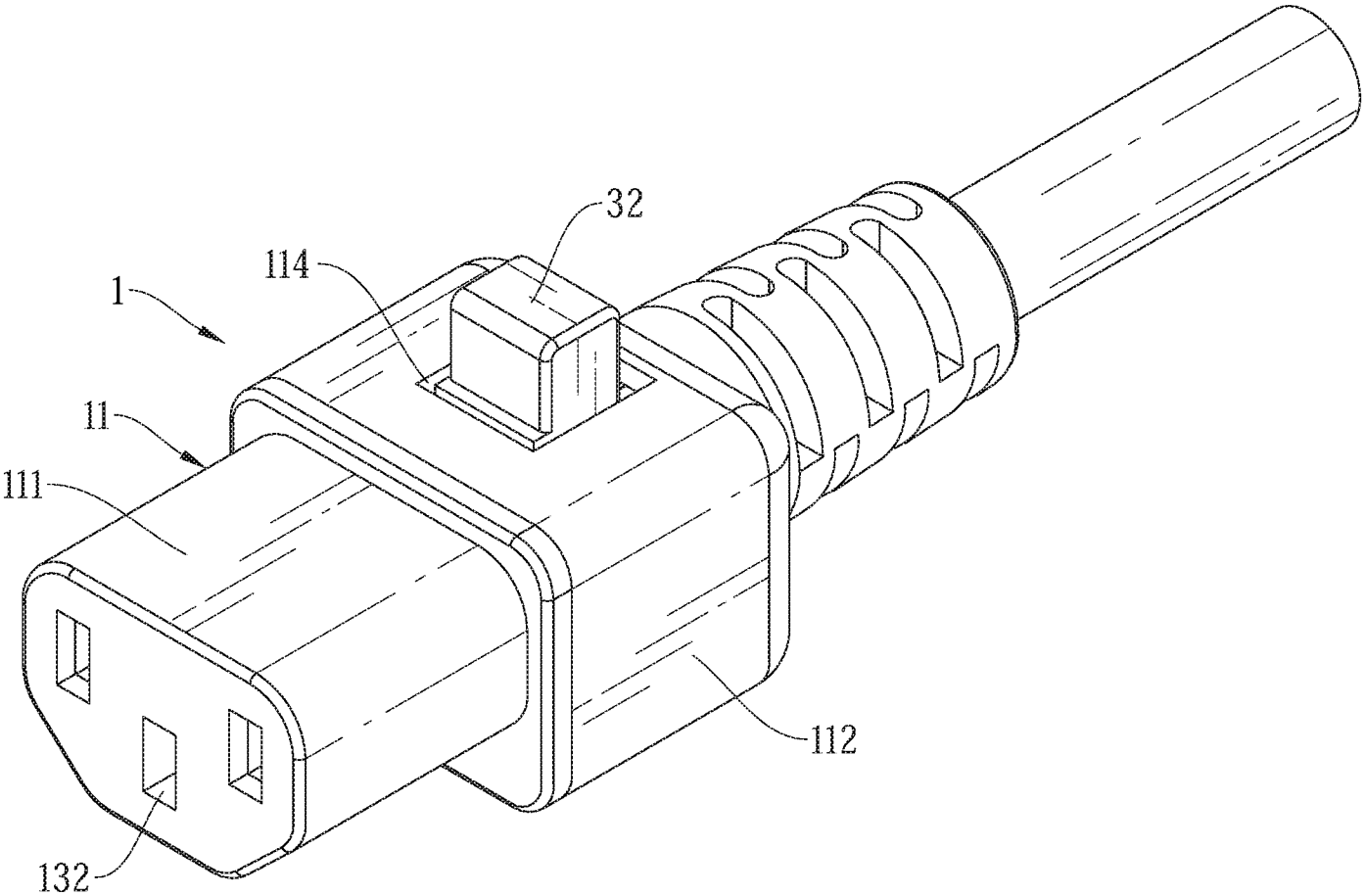
FIG. 1 is an oblique top elevational view of an anti-off socket in accordance with the present invention.
Figure 2:
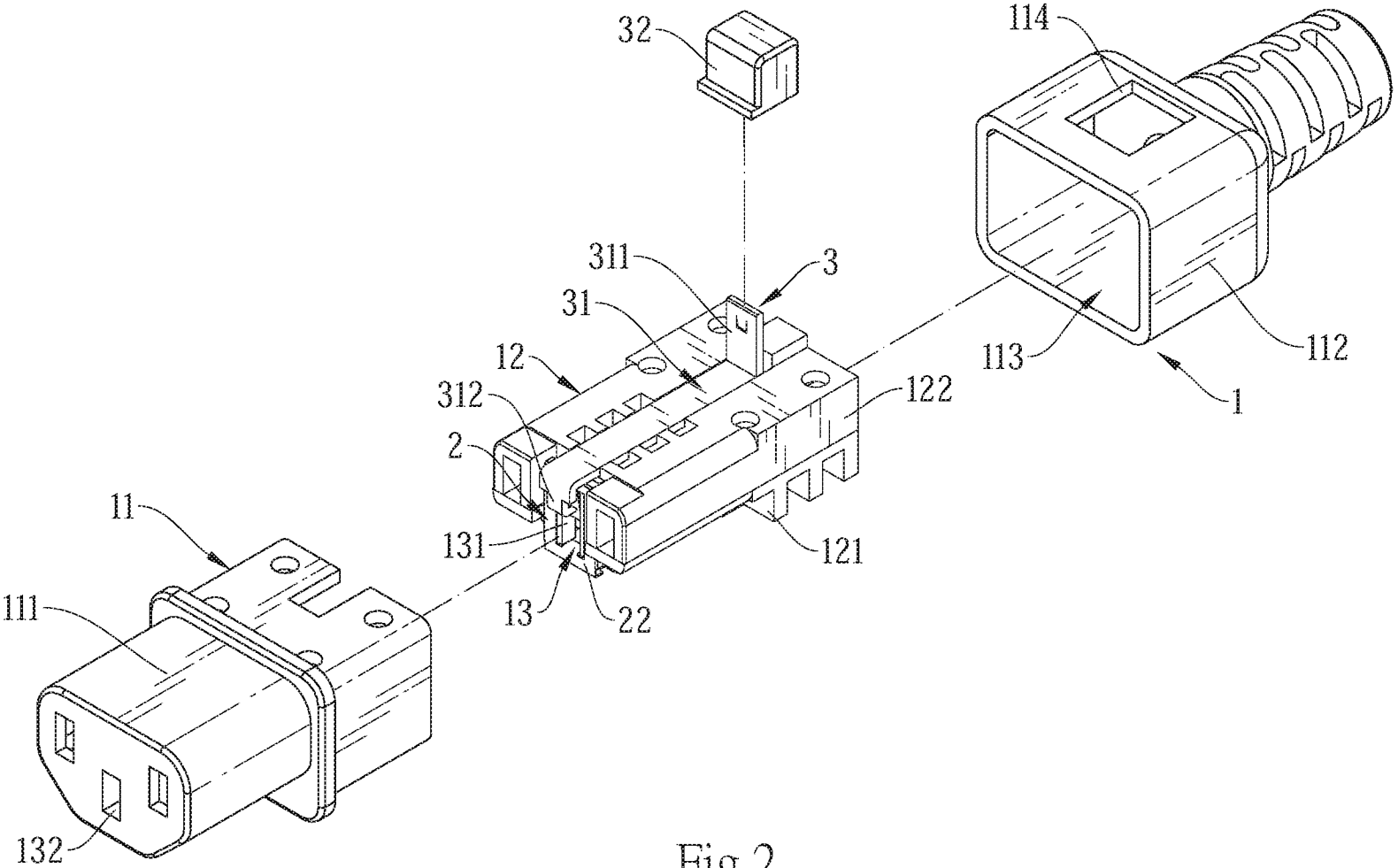
FIG. 2 is an exploded view of the anti-off socket in accordance with the present invention.
Figure 3:
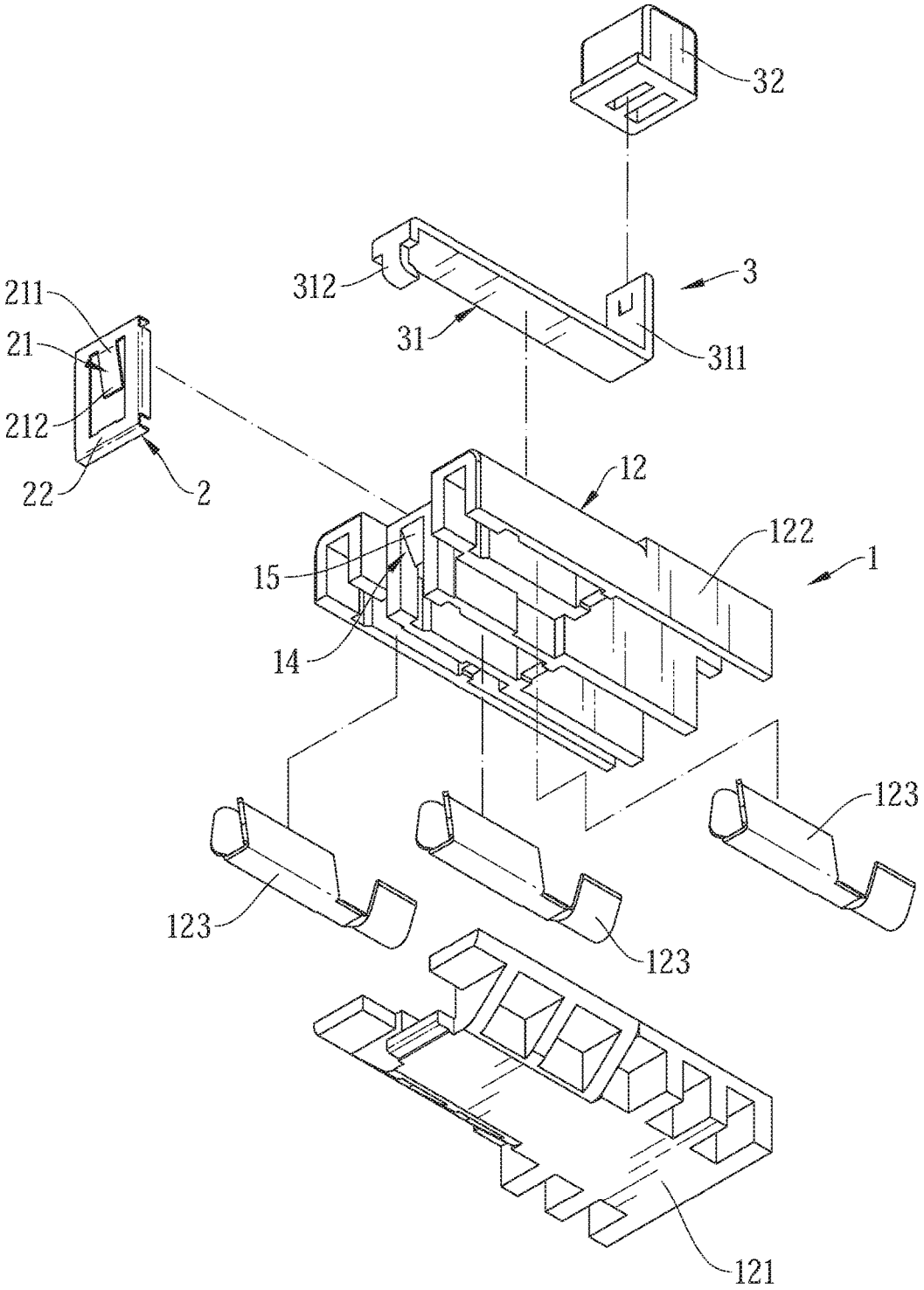
FIG. 3 is an exploded view of a part of the present invention, illustrating the structural details of the conducting terminal assembly.
Figure 4:
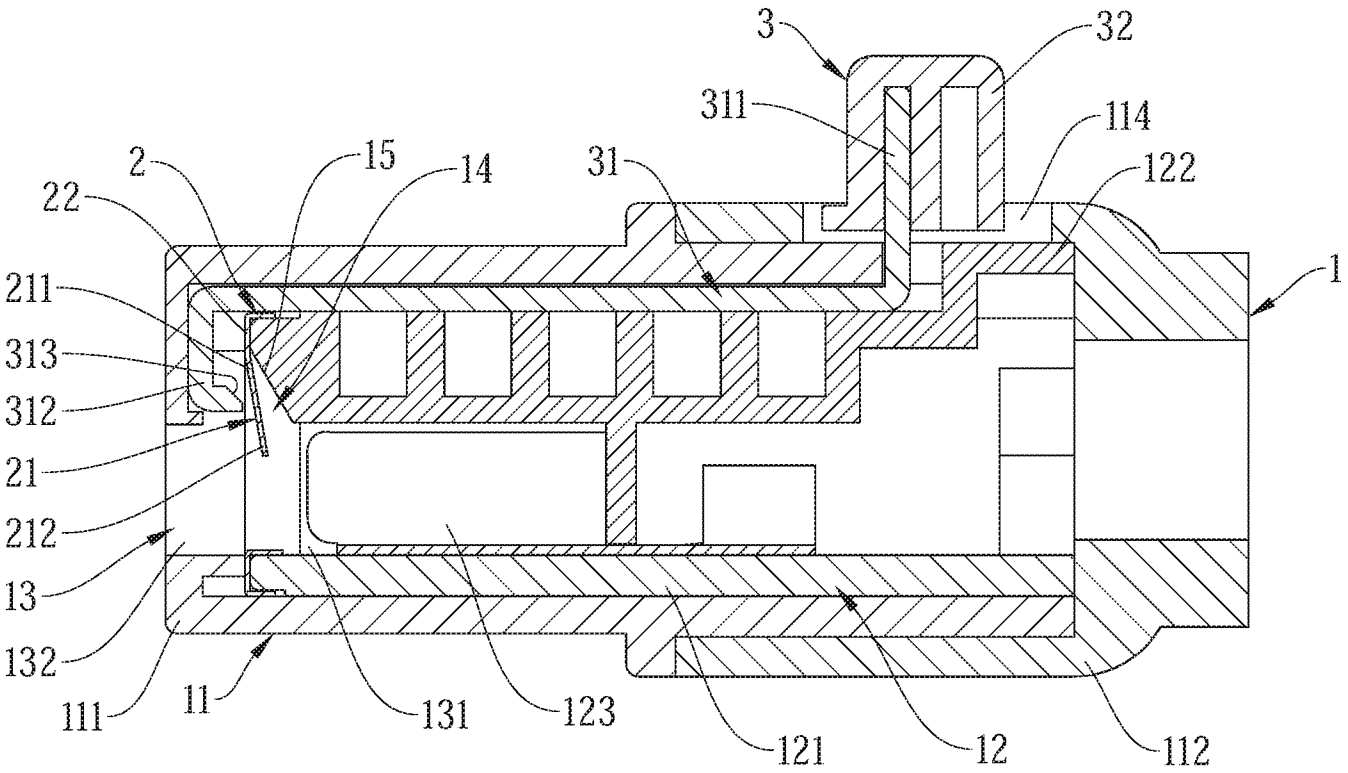
FIG. 4 is a sectional view of the present invention, illustrating the positioning of the conducting terminal assembly in the socket body and the relationship between the locking mechanism, the release mechanism and the conducting terminal assembly.

Referring to FIGS. 1-5 an anti-off socket in accordance with the present invention is shown. The anti-off socket comprises a socket body 1, a locking mechanism 2 and a release mechanism 3. The socket body 1 is adapted for receiving a plug 4. The locking mechanism 2 is adapted for locking the inserted plug 4 in the socket body 1. The release mechanism 3 is adapted for releasing the plug 4 from the constraint of the locking mechanism 2.

The socket body 1 comprises an electrically insulative housing 11, a conducting terminal assembly 12, and insertion spaces 13 for the insertion of respective blades 41 of the plug 4. The electrically insulative housing 11 consists of a front shell 111 and a rear shell 112. The front shell 111 and the rear shell 112 are fastened together, defining therein an accommodation chamber 113. The conducting terminal assembly 12 is mounted in the accommodation chamber 113, comprising a bottom block 121, a top cover 122 and a plurality of conducting terminals 123. The top cover 122 is covered on the bottom block 121. The conducting terminals 123 are adapted for the conduction of the blades 41 of the plug 4. The insertion spaces 13 are defined in between the bottom block 121 and the top cover 122, each comprising a channel 131 and an inlet 132 at a front end of the channel 131. In this embodiment, the channel 131 of each insertion space 13 is defined in a bottom side of the top cover 122 to face toward the bottom block 121; the inlet 132 of each insertion space 13 cuts through a front side of the front shell 111. The conducting terminals 123 of the conducting terminal assembly 12 are mounted in the channels 131 of the respective insertion spaces 13

The locking mechanism 2 is mounted in the socket body 1, comprising an elastic latch 21. The elastic latch 21 comprises a positioning segment 211 and an abutting segment 212. The positioning segment 211 is affixed to the socket body 1. The abutting segment 212 is inserted into one insertion space 13. In this embodiment, the locking mechanism 2 further comprises a positioning frame 22. The positioning frame 22 is affixed to the socket body 1 between the channel 131 and inlet 132 of the insertion space 13 on the middle of the socket body 1. The elastic latch 21 suspends in the positioning frame 22 with the positioning segment 211 connected to an inner side of the positioning frame 22. The abutting segment 212 obliquely extends toward the channel 131.

The release mechanism 3 is mounted in the socket body 1, comprising a release member 31 for biasing the elastic latch 21. In order to make the technical solutions and advantages of the present invention clearer, the release member 31 in this embodiment is configured to provide an operating segment 311 and an actuating segment 312. The operating segment 311 extends through a position-limiting hole 114 on the rear shell 112 to the outside of the socket body 1. The actuating segment 312 curves toward the elastic latch 21 of the locking mechanism 2 near the inlet 132. The actuating segment 312 defines an abutting slope 313. The release mechanism 3 further comprises a finger block 32 fastened to the operating segment 311 of the release member 31 and disposed outside the socket body 1 for pushing by the user to move the release member 31. Further, the moving distance of the finger block 32 is limited by the position-limiting hole 114.

Referring to FIGS. 4-7, the socket body 1 further comprises a displacement space 14 disposed above the channel 131 of the middle insertion space 13 near the associating inlet 132 for allowing the elastic latch 21 of the locking mechanism 2 to be biased within a predetermined range, and a beveled stop edge 15 adapted for stopping the elastic latch 21 to limit the biasing angle of the elastic latch 21.

Figure 5:
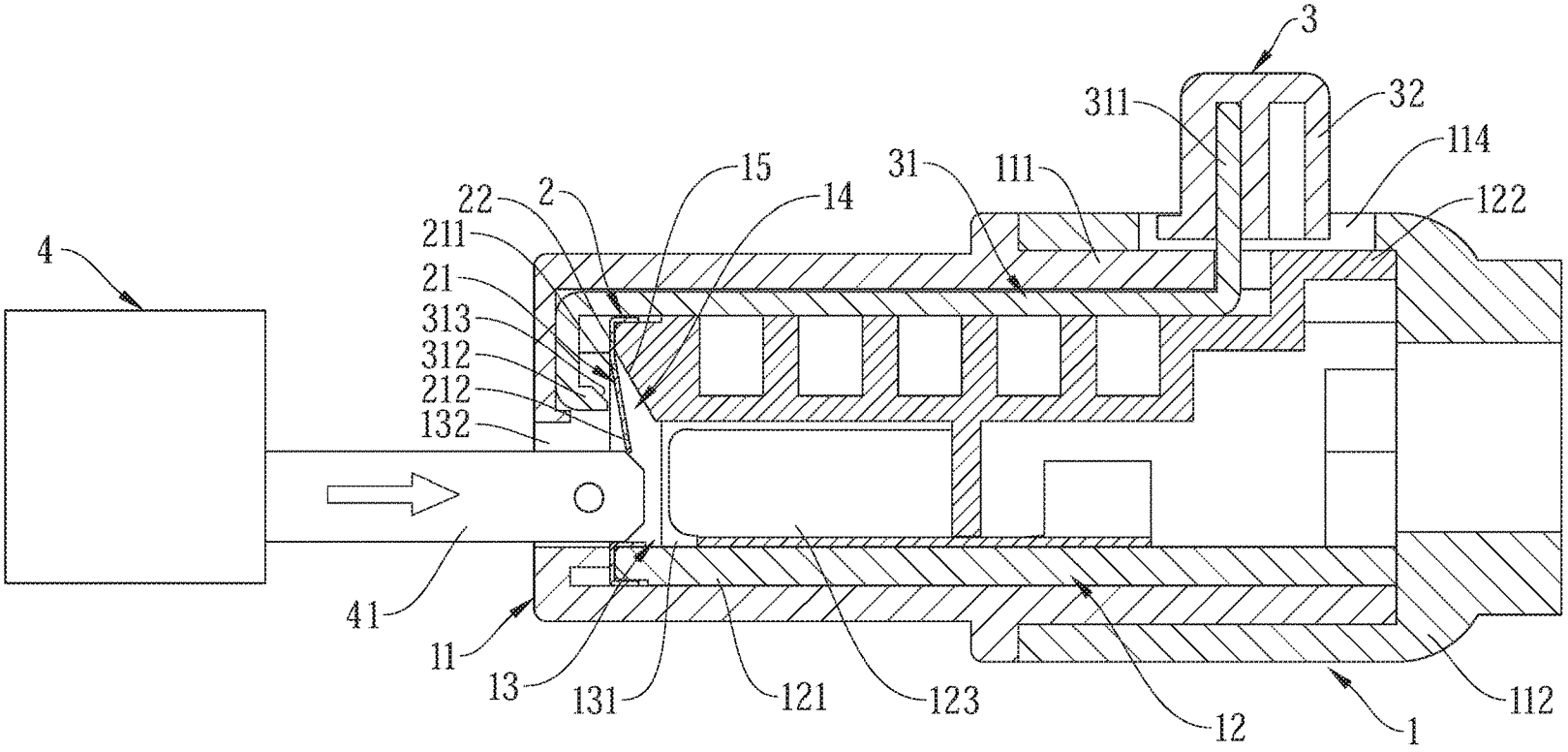
FIG. 5 is a schematic applied view of the present invention, illustrating the insertion of a plug in the socket body.
Figure 6:
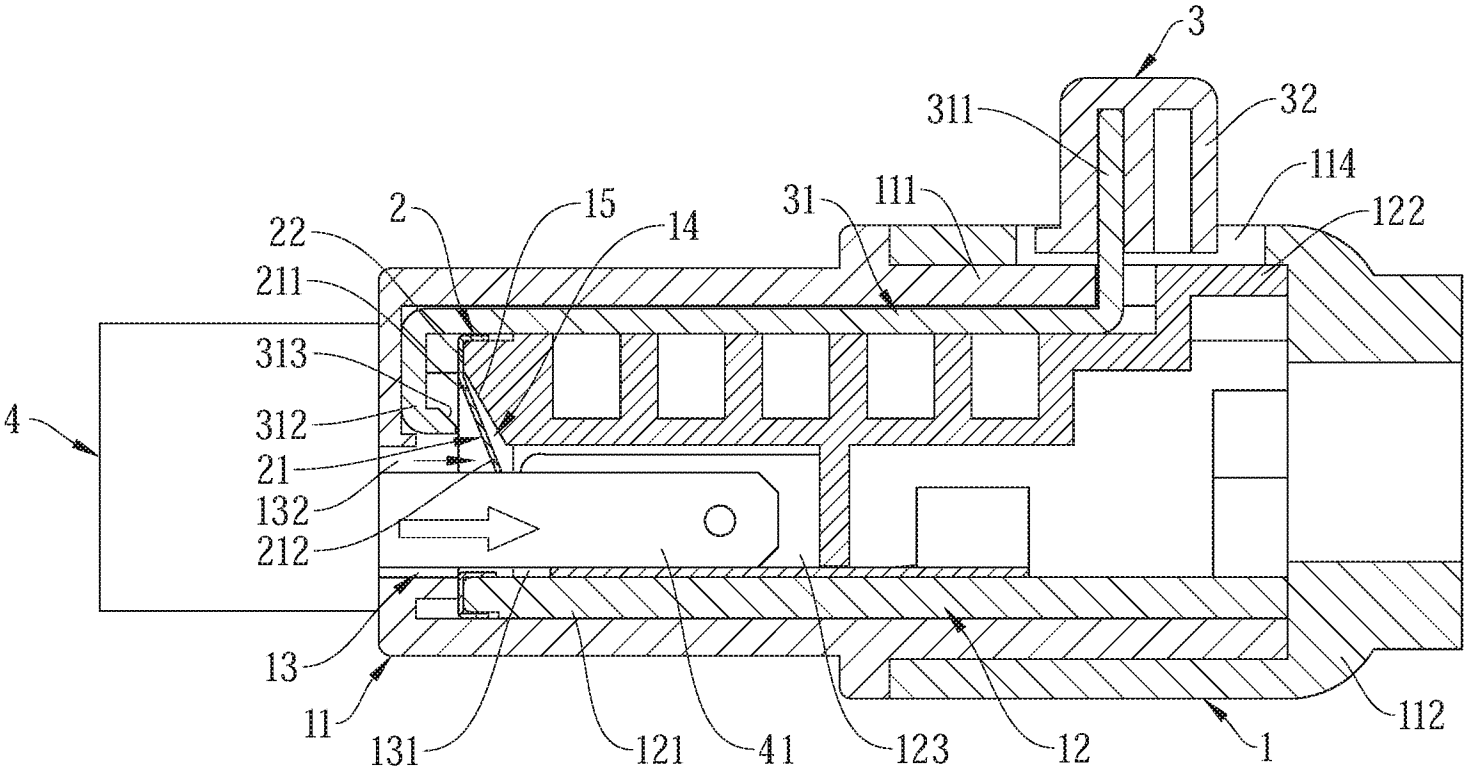
FIG. 6 corresponds to FIG. 5, illustrating the plug locked to the socket body.

When the plug 4 is inserted through the inlets 132 into the insertion spaces 13 in the socket body 1, as illustrated in FIGS. 5 and 6, one blade 41 of the plug 4 is forced against the abutting segment 212 of the elastic latch 21 to bias the abutting segment 212 in the insertion direction of the blade 41, allowing the blade 41 to enter the channel 131 of the respective insertion space 13 into contact with the respective conducting terminal 123. After the blade 41 entered the channel 131, the elastic restoring energy of the elastic latch 21 forces the abutting segment 212 into contact with the blade 41, locking the blade 41 in the socket body 1 and prohibiting the plug 4 from backward displacement relative to the socket body 1 to cause power failure.

Figure 7:
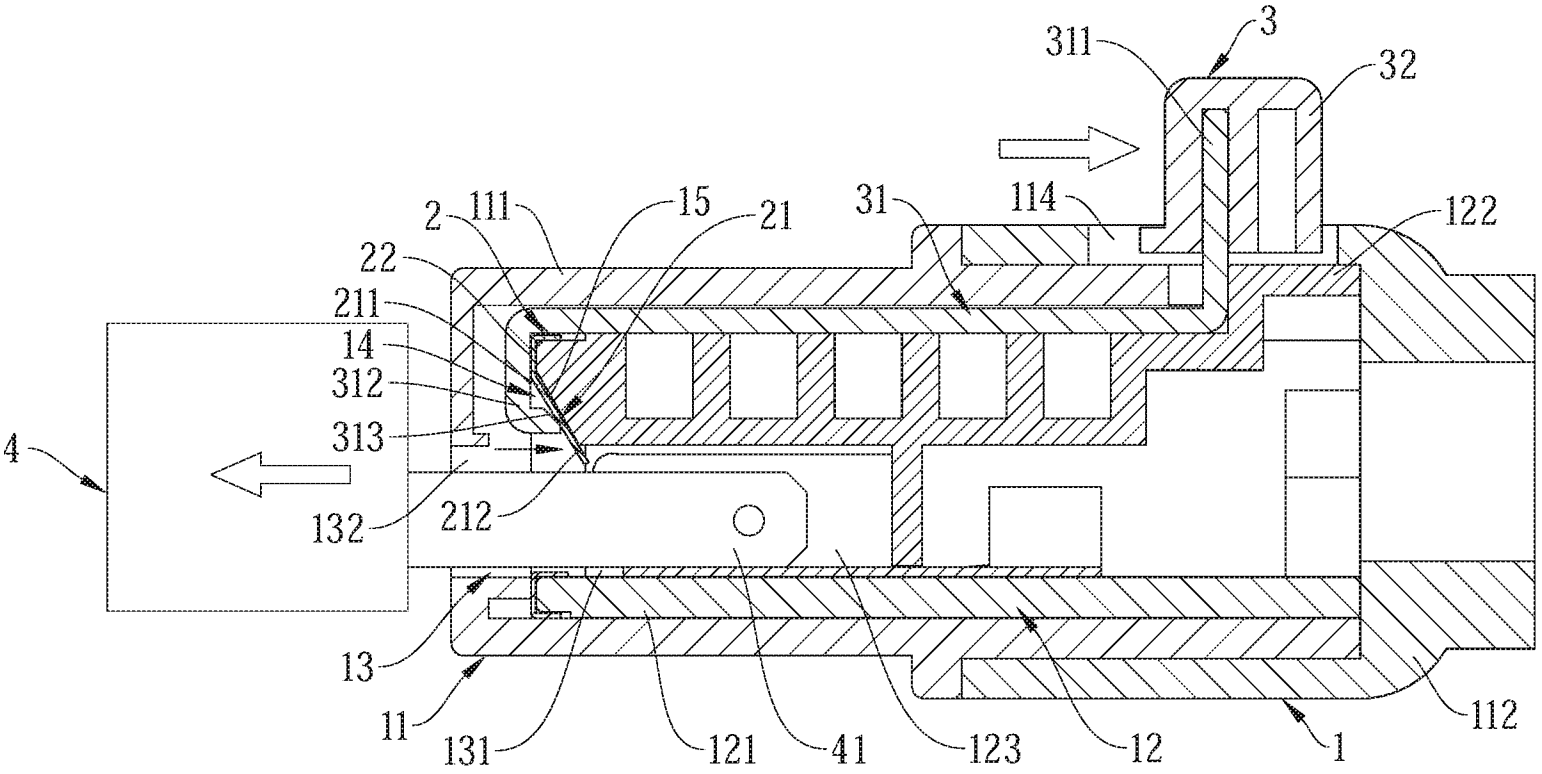
FIG. 7 corresponds to FIG. 6, illustrating the release mechanism operated, the plug unlocked from the socket body.

When the user needs to remove the plug 4 from the socket body 1, as illustrated in FIG. 7, push the finger block 32 of the release mechanism 3 to move the operating segment 311 of the release member 31 in forcing the actuating segment 312 against the elastic latch 21. At this time, the abutting slope 313 is acted upon the elastic latch 21 to bias the abutting segment 212 of the elastic latch 21 away from the blade 41 toward the beveled stop edge 15 in the displacement space 14, thereby unlocking the plug 4 from the socket body 1 and allowing removal of the plug 4 from the socket body 1.

The release member 31 of the release mechanism 3 is adapted for moving the elastic latch 21 of the locking mechanism 2 away from the blade 41 of the plug 4, thus, the release member 31 can be variously embodied to achieve the same effect. In the present preferred embodiment, the release member 31 is linearly moved to bias the elastic latch 21, however, this sliding design is not a limitation.

The technical features of the present invention to solve the problems and drawbacks of conventional designs are as follows:

A) The elastic latch 21 of the locking mechanism 2 is inserted into one insertion space 13 of the socket body 1. When the blades 41 of the plug 4 are inserted into the respective insertion spaces 13, the elastic latch 21 is stopped against the respective blade 41 in the socket body 1, prohibiting the plug 4 from backward displacement relative to the socket body 1 to cause power failure.

B) The release member 31 of the release mechanism 3 is disposed in the socket body 1 and operable to move the elastic latch 21 of the locking mechanism 2 away from the respective blade 41 of the plug 4 for allowing removal of the plug 4 from the socket body 1 conveniently.

What is claimed is:

1. A socket, comprising:

a socket body defining therein an insertion space for receiving a blade of a plug;

a locking mechanism mounted n said socket body said locking mechanism comprising:

a positioning frame non-movably fixed to said socket body, the positioning frame defining an opening aligned with the insertion space, the opening sized and positioned to accept an inserted blade of a plug passing through the opening; and an elastic latch comprising an elastically deformable abutting segment surrounded by said positioning frame and extending from a side of said positioning frame towards the opening and into said insertion space and being biased by the inserted blade of the plug passing through the opening, the abutting segment movable with respect to the positioning frame for allowing said inserted blade to enter said insertion space and biased by elastic restoring energy of said abutting segment to return to a previous position and to stop said inserted blade from backward displacement relative to said socket body after said inserted blade enters said insertion space; and a release mechanism mounted in said socket body, said release mechanism comprising a release member operable to force said abutting segment of said elastic latch away from said inserted blade for allowing removal of said plug from said socket body.

2. The socket as claimed in claim 1, wherein said release member of said release mechanism comprises an actuating segment curved from one end thereof and extending to one side of said elastic latch of said locking mechanism, and an operating segment located on an opposite end thereof and disposed outside said socket body for operation by a user to force said actuating segment against said elastic latch in moving and disengaging said elastic latch from said inserted blade of said plug for allowing removal of said plug from said socket body.

3. The socket as claimed in claim 1, wherein said insertion space of said socket body comprises a channel and an inlet at one end of said channel; and said positioning frame is affixed to said socket body between said channel and said inlet.

4. The socket as claimed in claim 3, wherein said socket body further comprises a displacement space facing toward said channel near said inlet for allowing said elastic latch of said locking mechanism to be displaced therein.

5. The socket as claimed in claim 3, wherein said socket body further comprises a displacement space facing toward said channel near said inlet for allowing said elastic latch of said locking mechanism to be displaced therein, and a beveled stop edge is disposed at one side relative to said displacement space remote from said inlet to limit displacement of said abutting segment within a predetermined range.

* * * * *